US007303783B2

(12) United States Patent
Kobayashi et al.

(10) Patent No.: US 7,303,783 B2
(45) Date of Patent: Dec. 4, 2007

(54) INKJET HEAD, MANUFACTURING METHOD THEREOF AND METHOD OF FORMING WATER REPELLENT FILM

(75) Inventors: Yasunori Kobayashi, Gifu (JP); Atsushi Ito, Owariasahi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 106 days.

(21) Appl. No.: 10/875,582

(22) Filed: Jun. 25, 2004

(65) Prior Publication Data

US 2005/0001880 A1 Jan. 6, 2005

(30) Foreign Application Priority Data

Jun. 30, 2003 (JP) ..... 2003-188995

(51) Int. Cl.
*B05D 3/02* (2006.01)

(52) U.S. Cl. ..... 427/374.1; 427/374.4; 427/374.5; 427/398.1; 427/398.3

(58) Field of Classification Search ..... None
See application file for complete search history.

(56) References Cited

U.S. PATENT DOCUMENTS

| | | | | |
|---|---|---|---|---|
| 3,904,794 | A * | 9/1975 | Brandt et al. | 427/375 |
| 5,387,440 | A | 2/1995 | Takemoto et al. | |
| 6,341,836 | B1 | 1/2002 | Koike et al. | |
| 6,511,156 | B1 | 1/2003 | Kazama et al. | |
| 6,561,624 | B1 | 5/2003 | Kikugawa et al. | |
| 6,799,832 | B1 * | 10/2004 | Adavikolanu et al. | 347/45 |
| 2003/0056721 | A1 | 3/2003 | Yamamoto et al. | |
| 2004/0088859 | A1 * | 5/2004 | Ito et al. | 29/890.1 |
| 2004/0263565 | A1 * | 12/2004 | Kobayashi et al. | 347/45 |
| 2005/0035999 | A1 * | 2/2005 | Kitahara et al. | 347/47 |

FOREIGN PATENT DOCUMENTS

| | | |
|---|---|---|
| JP | A 1-280566 | 11/1989 |
| JP | A 02-301429 | 12/1990 |
| JP | A 05-004344 | 1/1993 |
| JP | A 09-277537 | 10/1997 |
| JP | A 11-010892 | 1/1999 |
| JP | A 2000-263793 | 9/2000 |
| JP | A 2003-266699 | 9/2003 |
| WO | WO 99/15337 | 4/1999 |

OTHER PUBLICATIONS

Chinese Office Action with English Translation for Application No. 200410061990.6 issuing Jul. 28, 2006.

* cited by examiner

*Primary Examiner*—Erma Cameron
(74) *Attorney, Agent, or Firm*—Oliff & Berridge, PLC

(57) ABSTRACT

An inkjet head which is provided with a nozzle plate that is covered with a water repellent film including a Ni-PTFE film, and a plurality of nozzles that are formed through the nozzle plate to eject ink. In this structure, the nozzle plate is subjected to a heat treatment after the Ni-PTFE film is formed on the nozzle plate, and then is subjected to water cooling. The water cooling is performed using cooling water having a temperature ranging from 15° C. through 30° C. after the heat treatment is finished.

4 Claims, 7 Drawing Sheets

INKJET HEAD, MANUFACTURING METHOD THEREOF AND METHOD OF FORMING WATER REPELLENT FILM

BACKGROUND OF THE INVENTION

The present invention relates to an inkjet head provided, in printing devices, and a manufacturing method thereof. In particular, the present invention relates to a method of forming a water repellent film on the inkjet head.

In general, the inkjet head provided in printing devices such as a printer and a facsimile machine has a nozzle plate on which a plurality of nozzles for ejecting ink are arranged. In the inkjet head, the nozzles respectively communicate with pressure chambers, to which actuators such as piezoelectric elements are respectively attached. By operation of the actuator, a certain amount of ink pressurized in the pressure chamber is introduced to the nozzle, and then is ejected from the nozzle.

If the ink residues remain around an ejecting side of the nozzle, variations in an ejecting direction of the ink and/or in an ejecting amount of the ink may occur, which deteriorates accuracy of ejecting operation of the ink. For this reason, an ejecting side surface of the nozzle plate (hereafter, referred to as an ejecting surface) is typically covered with a water repellent film.

WO 99/15337 discloses an inkjet head covered with a water repellent film made of Ni-PTFE (polytetrafluoroethylene). The Ni-PTFE coating is made, for example, using electrolytic plating. The Ni-PTFE film is treated with heat at a temperature higher than the melting point of the Ni-PTFE, for example, 350° C. By the heat treatment, a portion of a surface of the Ni-PTFE film melts, by which the water repellent characteristic can be obtained.

SUMMARY OF THE INVENTION

Recently, density of the nozzles formed on the inkjet head is increasing to enhance resolution of an image to be formed. For this reason, demand for enhancing the water repellent characteristic of the nozzle plate is also increasing.

In the above mentioned publication WO 99/15337, it is disclosed that durability of the water repellent film can be enhanced by rapidly cooling the water repellent film by using, for example, water cooling. However, in the publication, no explanation is made on how to enhance the water repellent characteristic of the water repellent film.

The present invention is advantageous in that it provides an inkjet head configured to enhance a water repellent characteristic, a manufacturing method thereof, and a method of forming a water repellent film capable of enhancing the water repellent characteristic.

According to an aspect of the invention, there is provided an inkjet head, which is provided with a nozzle plate that is covered with a water repellent film including a Ni-PTFE film, and a plurality of nozzles that are formed through the nozzle plate to eject ink. In this structure, the nozzle plate is subjected to a heat treatment after the Ni-PTFE film is formed on the nozzle plate, and then is subjected to water cooling. The water cooling is performed using cooling water having a temperature ranging from 15° C. through 30° C. after the heat treatment is finished.

Since the nozzle plate having the Ni-PTFE film is cooled by using cooling water having a temperature ranging from 15° C. through 30° C., a receding contact angle of the water repellent film is increased and a water repellent characteristic of the Ni-PTFE film is enhanced.

Optionally, the heat treatment may be performed at a temperature ranging from 340° C. through 380° C., and may be performed for a time period raging from 10 minutes through 45 minutes.

Still optionally, the heat treatment may be performed at a temperature ranging from 350° C. through 360° C.

According to another aspect of the invention, there is provided a method of manufacturing an inkjet head having a nozzle plate through which a plurality of nozzles are formed. The method includes the steps of: forming a water repellent film including a Ni-PTFE film on an ink ejecting surface of the nozzle plate; heat treating the nozzle plate after the Ni-PTFE film is formed; and cooling the nozzle plate by water cooling using cooling water having a temperature ranging from 15° C. through 30° C. after the nozzle plate is heat treated.

Since the nozzle plate having the Ni-PTFE film is cooled by using cooling water having a temperature ranging from 15° C. through 30° C., the receding contact angle of the water repellent film is increased and the water repellent characteristic of the Ni-PTFE film is enhanced.

Optionally, the step of heat treating may be performed at a temperature ranging from 340° C. through 380° C., and is performed for a time period raging from 10 minutes through 45 minutes.

Still optionally, the step of heat treating may be performed at a temperature ranging from 350° C. through 360° C.

According to another aspect of the invention, there is provided a method of forming a water repellent film. The method includes the steps of: forming a water repellent film including a Ni-PTFE film on a workpiece; heat treating the workpiece after the Ni-PTFE film is formed; and cooling the workpiece by water cooling using cooling water having a temperature ranging from 15° C. through 30° C. after the workpiece is heat treated.

Since the workpiece having the Ni-PTFE film is cooled by using cooling water having a temperature ranging from 15° C. through 30° C., the receding contact angle of the water repellent film is increased and the water repellent characteristic of the Ni-PTFE film is enhanced.

Optionally the step of heat treating may be performed at a temperature ranging from 340° C. through 380° C., and may be performed for a time period raging from 10 minutes through 45 minutes.

Still optionally, the step of heat treating may be performed at a temperature ranging from 350° C. through 360° C.

BRIEF DESCRIPTION OF THE ACCOMPANYING DRAWINGS

DETAILED DESCRIPTION OF THE EMBODIMENTS

Figure 1:
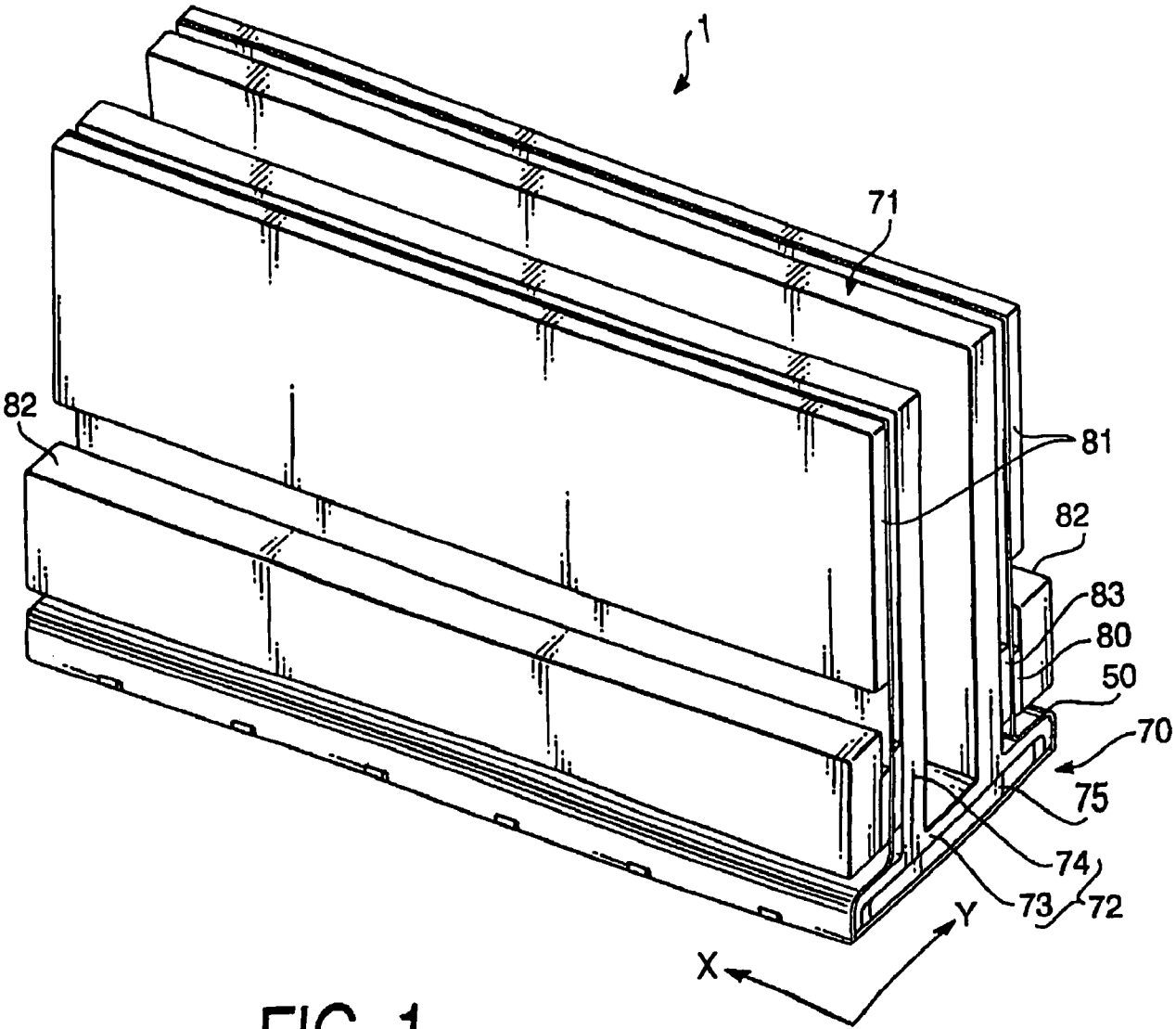
FIG. 1 is a perspective view of an inkjet head according to an embodiment of the invention.

FIG. 1 is a perspective view of an inkjet head 1, employed, for example, in an inkjet printer, according to an embodiment of the invention. The inkjet head 1 has a head unit 70 and a base 71. The inkjet head 70 is supported by the base 71. In the inkjet printer, the inkjet head 1 is moved in a main scanning direction (X direction) while a sheet of paper is moved in an auxiliary scanning direction (Y direction) which is perpendicular to the main scanning direction, so that two dimensional images can be formed on the sheet of paper.

As described in detail later, the inkjet head 1 has an ink flow channel unit 2 and an actuator unit 4 (see FIGS. 2 and 4). The ink flow channel unit 2 has a plurality of pressure chambers 10 and a plurality of nozzles 8 for rejecting ink. The actuator unit 4 is used to apply pressure to the pressure chambers 10 to eject the ink from the nozzles 8.

The base 71 includes a base block 75 and a holder 72. The base block 75 is attached to an upper surface of the head unit 70 to support the head unit 70. The holder 72 includes a body portion 73 and a supporting portion 74. As shown in FIG. 1, the supporting portion 74 is elongated toward a direction opposed to the head unit 70 side, so that the inkjet head 1 is supported in the inkjet printer.

On an outer region of the base 71, an FPC (flexible printed circuit) 50 is attached through an elastic member 81 such as a sponge. The FPC 50 electrically connects electrodes provided on the actuator unit 4 to a driver IC 80 which drives the actuator unit 4. Further, the FPC 50 electrically connects the driver IC 80 and a control board 81. As shown in FIG. 1, a heatsink 82 is attached to the driver IC 80 for heat radiation of the driver IC 80.

Figure 2:
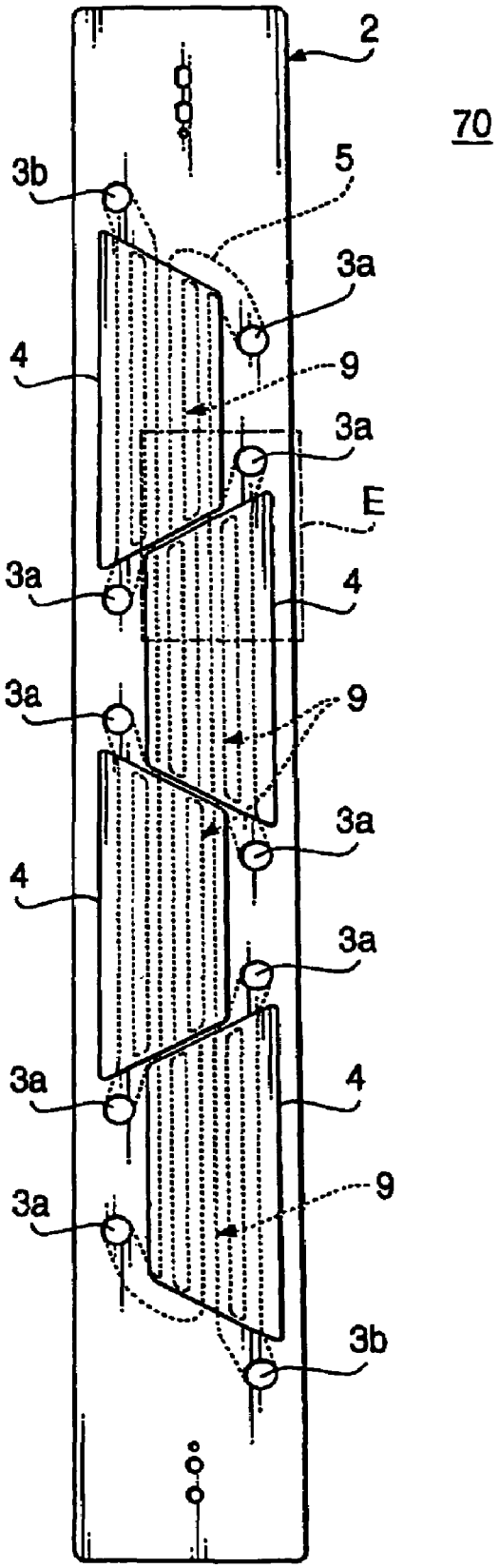
FIG. 2 is a plan view of the head unit shown in FIG. 1.

FIG. 2 is a plan view of the head unit 70. As shown in FIG. 2, the ink flow channel unit 2 has a rectangular form and has a plurality of ejection element groups 9. Adjacent ones of the ejection element groups 9 are shifted, in directions opposite to each other, by the same distance with respect to a center line of a shorter side of the ink flow channel unit 2. Each ejection element group 9 has a trapezoidal form.

On each ejection element group 9, the actuator unit 4 having an piezoelectric actuator is attached. The ejection element groups 9 are supplied with ink from manifolds 5 which communicate with ink reservoirs (not shown), via apertures 3*a* and 3*b*.

Figure 3:
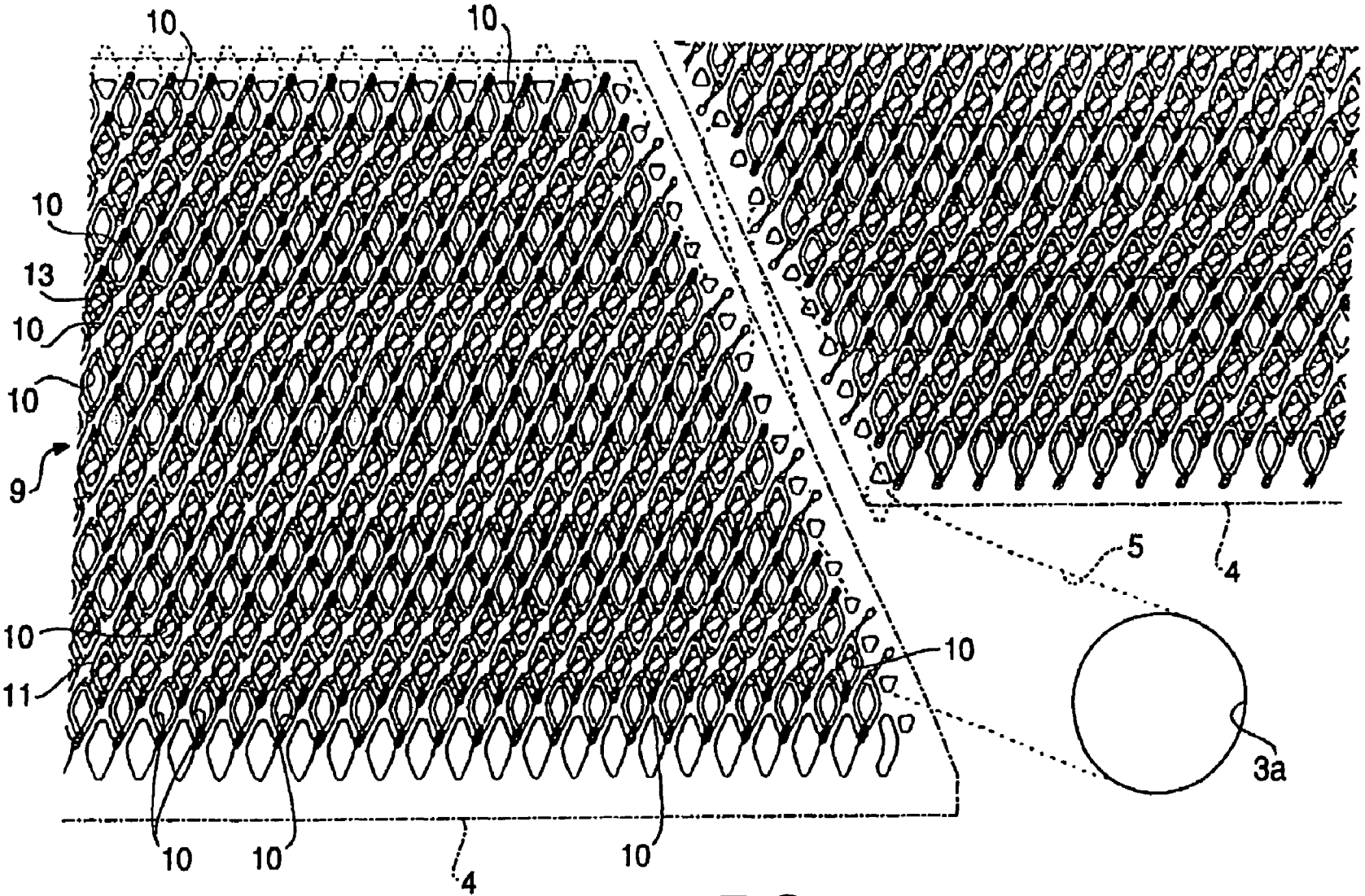
FIG. 3 is an enlarged view of a section of FIG. 2.

FIG. 3 is an enlarged view of a section E shown in FIG. 2. As shown in FIG. 3, each ejection element group 9 is formed with a number of ejection elements 11 arranged in a matrix. As described in detail later, each ejection element 11 has an aperture 13 communicating with the manifold 5, the pressure chamber 10 and the nozzle 8 (see FIGS. 4 and 5).

Figure 4:
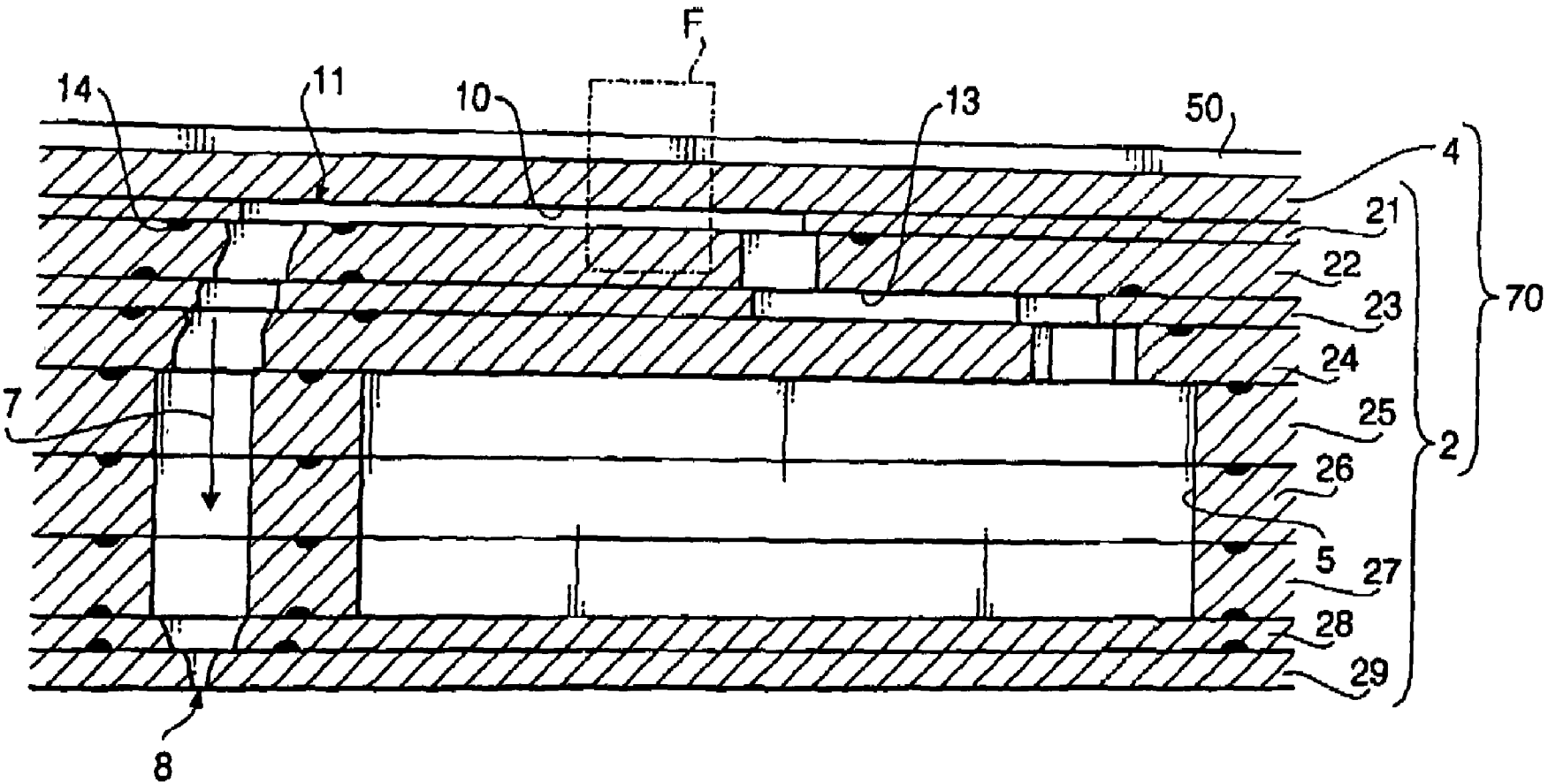
FIG. 4 is a cross sectional view of an ejection element in the inkjet head.

FIG. 4 is a cross sectional view of the ejection element 11. As shown in FIG. 4, the ink flow channel unit 2 has a laminated structure of a plurality of thin plate layers each made of, for example, Ni (nickel). More specifically, the ink flow channel unit 2 has, from an actuator side, a cavity plate 21, a base plate 22, an aperture plate 23, a supply plate 24, manifold plates 25, 26 and 27, a cover plate 28, and a nozzle plate 29.

The pressure chamber 10 is formed by the cavity plate 21. By the operation of the actuator unit 4, the pressure chamber 10 sucks in the ink from the manifold 5 and applies pressure to the ink introduced therein to eject the ink from the nozzle 8. The aperture plate 23 is formed with the aperture 13 and an opening constituting a part of an outlet channel 7. The aperture 13 is used to decrease/increase flow of the ink flowing from the manifold 5 to the pressure chamber 10. The base plate 22 is formed with an opening through which the aperture 13 communicates with the pressure chamber 10, and an opening constituting a part of the outlet channel 7.

By a laminated structure of the manifold plates 25, 26 and 27, the manifold 5 and openings constituting a part of the outlet channel 7 are formed. The cover plate 28 is formed with openings constituting the outlet channel 7. The nozzle plate 29 is formed with openings constituting the nozzles 8 from which the ink flowing from the pressure chamber 10 is ejected.

By the above mentioned laminated structure, a plurality of ink flow channels are formed in the ink flow channel unit 2. As shown in FIG. 4, each thin plate layer has grooves 14 which trap redundant glue. By the grooves 14, an occurrence of clogging of the ink flow channel and/or variations of resistance of the ink flow channel are prevented, and therefore ejection performances of the plurality of ejection elements are uniformed.

Figure 5:
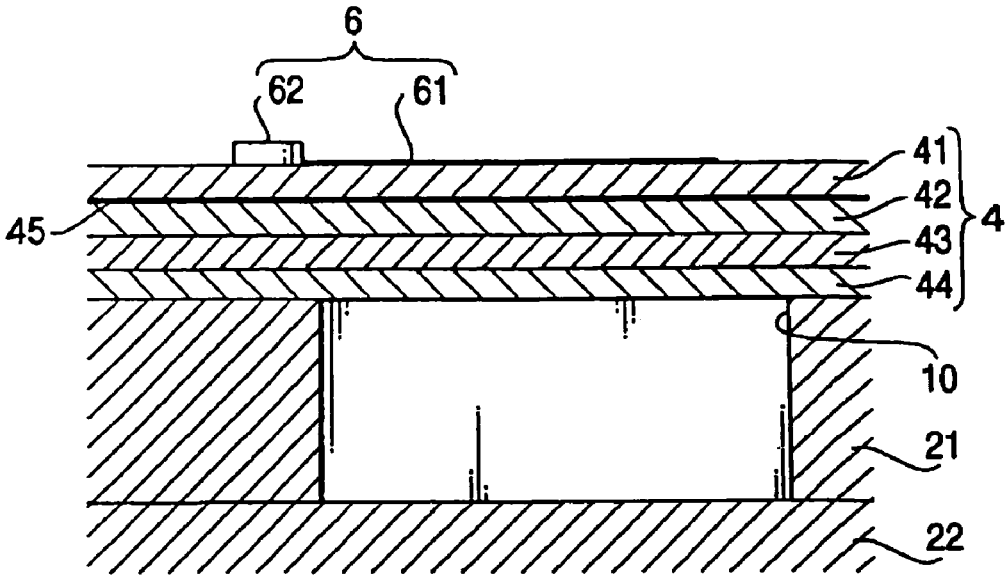
FIG. 5 is an enlarged view of a section of FIG. 4 illustrating a detailed structure of an actuator unit.

FIG. 5 is an enlarged view of a section F shown in FIG. 4 illustrating a detailed structure of the actuator unit 4. As shown in FIG. 5, the actuator unit 4 has a laminated structure of a plurality of piezoelectric sheets 41, 42, 43 and 44, and an internal electrode 45. On a surface of the actuator unit 4 furthest from the ink flow channel unit 2, an electrode unit 6 is formed for each pressure chamber 10.

Figure 6:
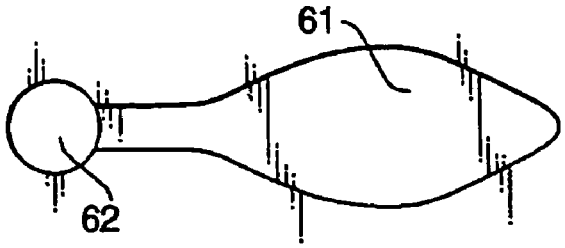
FIG. 6 is a plan view of an electrode unit located on the actuator unit.

FIG. 6 is a plan view of the electrode unit 6. As shown in FIG. 6, the electrode unit 6 has a land 62 and an electrode 61. The electrode 61 has a rhombic shape which is substantially the same as the shape of the pressure chamber 10 when the electrode 61 and the pressure chamber 10 are viewed as plane views. Thus, the actuators respectively corresponding to ejection elements 11 are formed.

With this structure, when a voltage is applied to the electrode 61, the pressure chamber 10 distorts and the volumetric capacity of the pressure chamber changes, so that suction/ejection of the ink can be performed.

Figure 7:
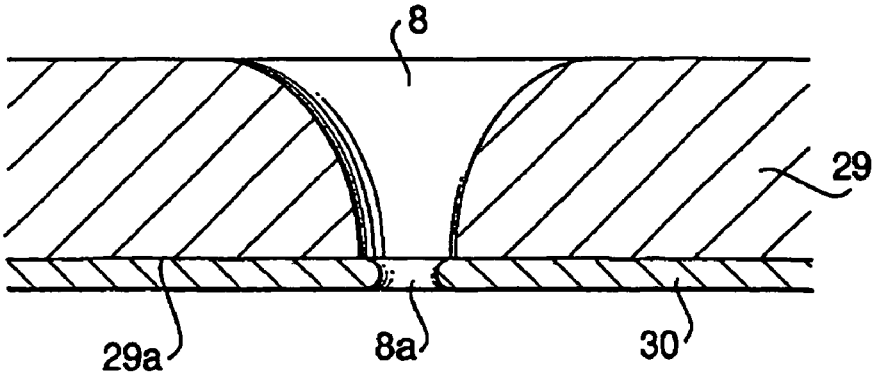
FIG. 7 is a cross sectional view of a nozzle.

FIG. 7 is a cross-sectional view of the nozzle 8. As shown in FIG. 7, on an outside surface of the nozzle plate 29, a water repellent film 30 made of, for example, Ni-PTFE (polytetrafluoroethylene) is formed. The water repellent film 30 prevents the ink from remaining at the periphery of the ejecting side of the nozzle 8, by which accuracy of ink ejection operation is enhanced.

Figure 8:
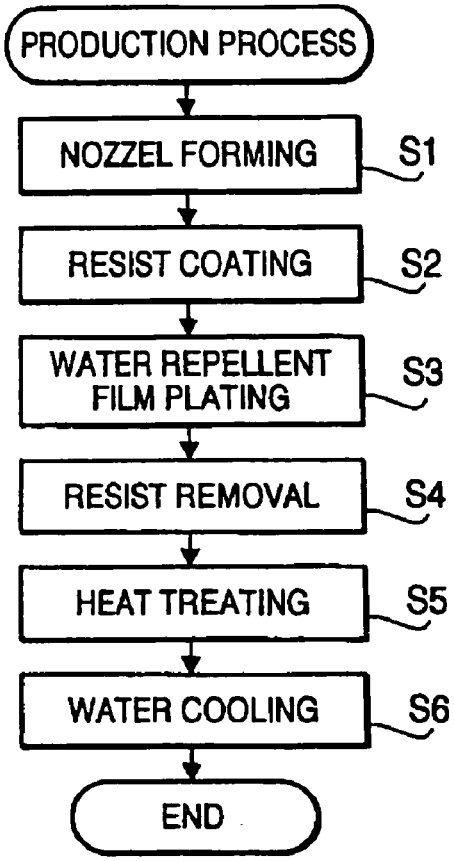
FIG. 8 shows a production process of a nozzle plate.

FIG. 8 shows a production process of the nozzle plate 29. In a nozzle forming process (step S1), the plurality of ejection element groups 9 each having the plurality of nozzles 8, each of which tapers toward the ejecting side thereof as shown in FIG. 8, are formed through the nozzle plate 29 by using, for example, press working.

In a resist coating process (step S2), the ejecting side surface of the nozzle plate 29 is coated with a resist, so that the nozzle 8 is filled with the resist. Consequently, it is prevented that the water repellent film adheres to an internal surface of each nozzle 8. Also, deterioration of the accuracy of the ink ejection operation can be prevented.

Next, in a water repellent film plating process (step S3), the water repellent film made of, for example, the Ni-PTFE film, is formed on the ejecting side surface of the nozzle plate 29 using, for example, electrolytic plating. In a resist removal process (step S4), the resist filled in the nozzle 8 is removed.

In a heat treatment process (step S5), the nozzle plate 29 is treated with heat, for example, in a thermostatic oven. More specifically, the nozzle plate 29 is treated with heat at a temperature range of 340° C. through 380° C. for a time period ranging from 10 minutes through 45 minutes. The temperature of the heat treatment is higher than a melting point of the PTFE (i.e., 327° C.), and is lower than a temperature of 400° C. at which the pyrolysis of the PTFE is caused.

With the above mentioned heat treatment, the PTFE situated on a surface of the film melts and spreads wide without altering the quality thereof. Consequently, the film 30 having the excellent water repellent characteristic and homogeneity is obtained.

In a water cooling process (step S6), the heat treated nozzle plate 29 is dipped into water having a temperature ranging from 15° C. through 30° C. for cooling. With this cooling process, the film 30 can obtain excellent water repellent characteristic.

The water repellent characteristic against the ink is represented by a receding contact angle that is measured when the ink placed on a sample is being sucked at a constant rate. The greater the receding contact angle of the material becomes, the more water repellent characteristic of the material becomes excellent. Table 1 shows a relationship between the receding contact angle of the Ni-PTFE film on the nozzle plate 29 and the temperature of the heat treatment in step S5. As shown in Table 1, the relationship is represented for each of three cooling methods including the water cooling, air cooling and cooling in the thermostatic oven.

TABLE 1

| | | TEMPERATURE OF HEAT TREEATMENT (° C.) | | | | |
|---|---|---|---|---|---|---|
| | | 340 | 350 | 360 | 380 | 400 |
| RECEDING CONTACT ANGLE (degree) | WATER COOLING(25° C.) | 39.5 | 42.7 | 39.4 | 39.8 | |
| | AIR COOLING | 37.4 | 37.9 | 38.1 | 33.7 | 25.3 |
| | COOLING IN THERMOSTATIC OVEN | | | 22.7 | 14.1 | |

Figure 9:
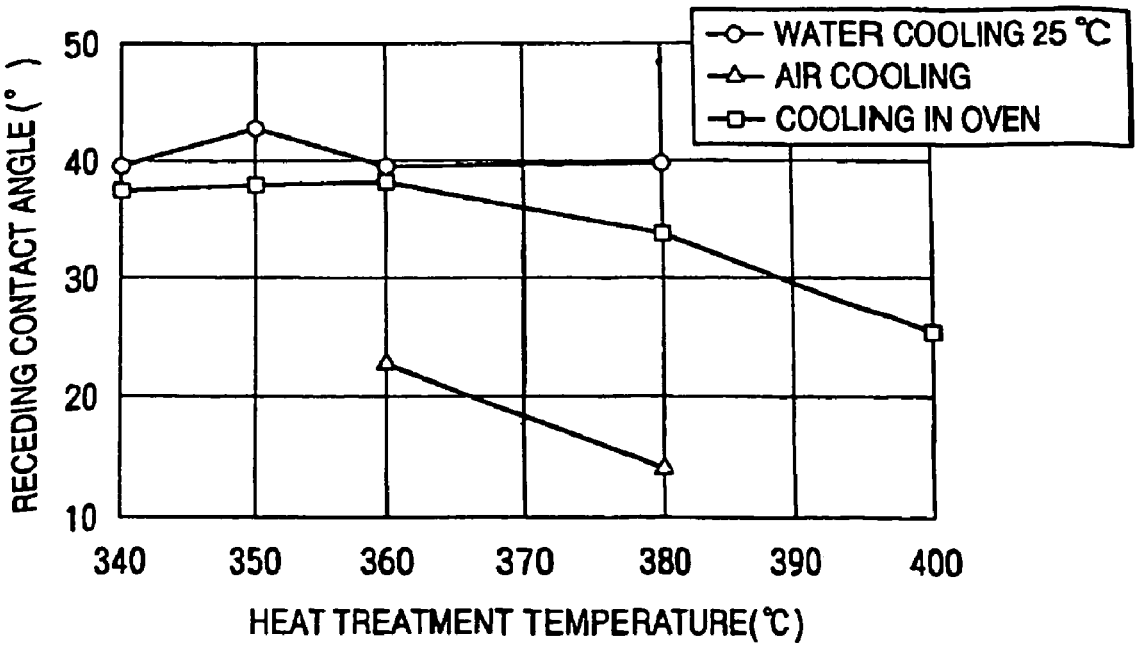
FIG. 9 is a graph illustrating a relationship between a receding contact angle of a Ni-PTFE film on the nozzle plate and temperature of a heat treatment.

FIG. 9 is a graph illustrating the relationship between the receding contact angle of the Ni-PTFE film on the nozzle plate 29 and the temperature of the heat treatment in step S5. As shown in FIG. 9, the relationship is represented by three curves corresponding to the water cooling, the air cooling and the cooling in the thermostatic oven, respectively. In Table 1 and FIG. 9, the PTFE content is 35~40 vol %, the heat treatment time is ten minutes and the thickness of the PTFE film is 1 micrometer.

As can be seen from Table 1 and FIG. 9, when the Ni-PTFE film is cooled in the thermostatic oven after the heat treatment, the receding contact angle becomes smaller, and therefore desirable water repellent characteristic is not obtained. When the Ni-PTFE film is cooled by the air cooling after the heat treatment, if the temperature range of the heat treatment is 340° C.~360° C. a relatively high receding contact angle larger than or equal to 37° is obtained.

When the Ni-PTFE film is cooled by the water cooling after the heat treatment, if the temperature range of the heat treatment is 340° C.~380° C. a very high receding contact angle larger than or equal to 39° is obtained.

Therefore, the water cooling after the heat treatment at the temperature of 340° C.~380° C. is desirable. If the temperature of the beat treatment is set at 350° C.~360° C., the water repellent characteristic can be further enhanced. Accordingly, when the temperature of the heat treatment is set at 350° C.~360° C., the uniform high receding contact angle over the entire nozzle plate 29 can be secured even if a certain degree of temperature variation occurs.

Table 2 shows a relationship between the receding contact angle of the Ni-PTFE film on the nozzle plate 29 and the temperature of the water cooling in step S6.

TABLE 2

| | WATER COOLING TEMPERATURE (° C.) | | | | | | | |
|---|---|---|---|---|---|---|---|---|
| | 0 | 5 | 10 | 15 | 25 | 30 | 50 | 100 |
| RECEDING CONTACT ANGLE (degree) | 35.4 | 35.4 | 39.2 | 42.0 | 42.7 | 42.5 | 35.0 | 30.0 |

Figure 10:
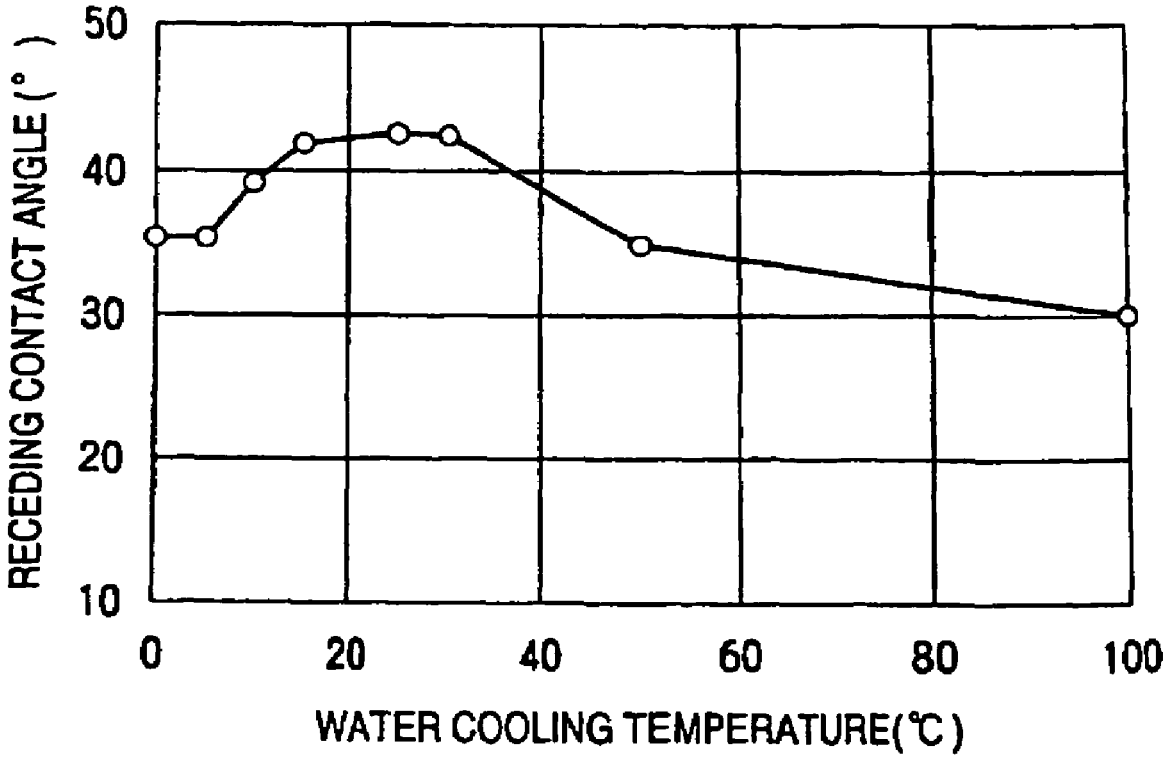
FIG. 10 is a graph illustrating a relationship between the receding contact angle of the Ni-PTFE film on the nozzle plate and temperature of water cooling.

FIG. 10 is a graph illustrating the relationship between the receding contact angle of the Ni-PTFE film on the nozzle plate 29 and the temperature of the water cooling in step S6. In FIG. 10, the horizontal axis represents the temperature (° C.) of the water cooling, and the vertical axis represents the receding contact angle (°). In Table 2 and FIG. 10, the PTFE content is 35~40 vol %, the temperature of the heat treatment is 350° C. the heat treatment time is ten minutes and the thickness of the PTFE film is 1 micrometer.

As can be seen from Table 2 and FIG. 10, the receding contact angle decreases when the water cooling temperature is about 0° C. or when the water cooling temperature is high. When the water cooling temperature is set at 15° C.~30° C., the high receding contact angle greater than or equal to 38° can be attained. If the water cooling temperature is set at 15° C.~25° C., the water repellent characteristic can be further enhanced. Accordingly, when the water cooling temperature is set at 15° C.~30° C. or 15° C.~25° C. a constant high receding contact angle of the Ni-PTFE film over the entire nozzle plate 29 can be attained.

An appropriate effect of the heat treatment can not be obtained if the heat treatment time is short, and the pyrolysis of the PTFE may be caused if the heat treatment time is excessively long. For this reason, typically, the heat treatment time is set at 10~40 minutes.

According to the embodiment of the invention, the nozzle plate having the Ni-PTFE film is cooled under a certain cooling condition including the air cooling and the water cooling, desirable water repellent characteristic can be attained.

Although the present invention has been described in considerable detail with reference to certain preferred embodiments thereof, other embodiments are possible.

For example, although in this embodiment the electrolytic plating is used to form the Ni-PTFE film, other plating processes such as electroless plating may be used to the Ni-PTFE film.

The present disclosure relates to the subject matter contained in Japanese Patent Application No. 2003-188995, filed on Jun. 30, 2003, which is expressly incorporated herein by reference in its entirety.

What is claimed is:

1. A method of manufacturing an inkjet head having a nozzle plate through which a plurality of nozzles are formed, comprising the steps of:

forming a water repellent film including a Ni-PTFE film on an ink ejecting surface of the nozzle plate;

heat treating the nozzle plate after the Ni-PTFE film is formed; and cooling the nozzle plate by water cooling using cooling water having a temperature ranging from 15° C. through 30° C. after the nozzle plate is heat treated, wherein the step of heat treating is performed at a temperature ranging from 340° C. through 380° C., and is performed for a time period raging from 10 minutes through 45 minutes.

2. The method according to claim 1, wherein the step of heat treating is performed at a temperature ranging from 350° C. through 360° C.

3. A method of forming a water repellent film, comprising the steps of:

forming a water repellent film including a Ni-PTFE film on a workpiece;

heat treating the workpiece after the Ni-PTFE film is formed; and cooling the workpiece by water cooling using cooling water having a temperature ranging from 15° C. through 30° C. after the workpiece is heat treated, wherein the step of heat treating is performed at a temperature ranging from 340° C. through 380° C., and is performed for a time period raging from 10 minutes through 45 minutes.

4. The method according to claim 3, wherein the step of heat treating is performed at a temperature ranging from 350° C. through 360° C.

* * * * *